US005605079A

United States Patent [19]

Way

[11] Patent Number: 5,605,079

[45] Date of Patent: Feb. 25, 1997

[54] TORSION SPRING TENSIONING TOOL

[76] Inventor: Robert L. Way, 820 Muirfield Dr., Arroyo Grande, Calif. 93420

[21] Appl. No.: 556,485

[22] Filed: Nov. 13, 1995

[51] Int. Cl.[6] ..... B25B 13/46

[52] U.S. Cl. ..... 81/61; 81/486; 81/176.3

[58] Field of Search ..... 81/60–62, 176.2, 81/176.3, 486; 29/227, 240

[56] References Cited

U.S. PATENT DOCUMENTS

| | | | |
|---|---|---|---|
| 2,567,563 | 9/1951 | Hribar | 81/3 |
| 3,651,719 | 3/1972 | Wessel | 81/63.2 |
| 3,979,977 | 9/1976 | Dorma | 81/57 |
| 4,142,283 | 3/1979 | Walker | 29/227 |
| 4,253,350 | 3/1981 | De Tarr | 81/3 |
| 4,526,066 | 7/1985 | Steck | 81/486 |
| 4,691,428 | 9/1987 | Engstrom | 29/426 |

*Primary Examiner*—James G. Smith
*Attorney, Agent, or Firm*—Jack C. Munro

[57] ABSTRACT

A tool for applying rotational force to a coiled torsion spring of a door counterbalancing mechanism in order to wind the spring storing energy within the body of the spring. The tool includes a splittable housing which is fixedly mounted onto the winding cone of the torsion spring. The housing has a sprocket mounted thereon. On either side of the sprocket are annular grooves. Within one annular groove is to be located a right hand operated ratchet tool with a left hand ratchet tool connecting with the other annular groove. These ratchet tools are to be used sequentially in unison to create stored energy within the torsion spring.

2 Claims, 4 Drawing Sheets

TORSION SPRING TENSIONING TOOL

BACKGROUND OF THE INVENTION

1) Field of the Invention

The field of this invention relates to hand tools and more particularly to a hand tool for applying rotational force to an object such as a torsion spring.

2) Description of the Prior Art

Overhead doors are in common use. The most common area of usage for an overhead door is for a garage in a home and for a warehouse in a place of business. The garage and the warehouse utilize an enlarged access opening. This access opening is to be closeable through the use of an overhead door. The overhead door is capable of being raised to assume a raised position providing unobstructed access through the access opening.

In order to raise the overhead door, it is necessary to lift the weight of the door. Lifting the weight either manually or by an automatic door opener would normally take a substantial amount of force as such overhead doors can weigh as much as several hundred pounds. In order to provide for ease of raising of an overhead door, it is common to incorporate a counterbalancing mechanism in conjunction with the door. One common form of such a counterbalancing mechanism utilizes a torsion spring. A length of torsion spring which is mounted with a winding cone on each end and this assembly is mounted around a rotatable horizontal shaft. One end of the spring is fixedly secured to the frame of a garage or warehouse. The other end of the spring is fixed onto a winding cone which is fixedly secured to the torsion shaft that runs through the torsion spring. A cable drum is fastened to the torsion shaft and a length of cable extends from the drum to the overhead door. As the door is lowered, cable is rolled from the drum, rotating the shaft and placing the spring in torsion, thus storing part of the potential energy due to the weight of the door. In elevating of the door, the spring exerts an upward force transmitted through the torsion shaft, drum and cable to assist in raising the door, counterbalancing the weight of the door, thus reducing the exterior force that is required in order to lift the overhead door. Normally the amount of spring force that is emitted is just slightly less than the amount of force that is required to lift the door. This means that the normal at rest position of the door is in the position closing the access opening. However, upon application of a slight lifting force to the door, the door will then proceed to move to its open position.

It is to be understood that although the subject matter of this invention has found particular utility in conjunction with overhead doors, it is considered to be within the scope of this invention that it could be used with other structure, but not limited to, closures such as an awning and a gate.

During installation of the door or during replacement of a defective spring, it is necessary to wind the spring to provide the desired amount of potential energy. The winding of the spring in the past has been accomplished by using a pair of rods which are inserted within holes provided within the winding cone of the torsion spring apparatus. One of the bars when inserted in conjunction with the winding cone is to be lifted to pivot as much as 50 or 60 degrees. Then a second bar is inserted within a similar opening provided within the winding cone and force is applied to that bar pivoting of the winding cone again another 50 or 60 degrees with the first bar having been removed from the winding cone. This sequential winding type procedure is continued until the desired amount of potential energy is achieved within the torsion spring. The disadvantage of this technique is that it is exceedingly common for these bars to slip free from the hole provided within the winding cone. The result is the bar can be propelled in an undesirable direction and it is exceedingly common that installers can be injured by such a bar. Also, some times the force is so great that a rod may be bent which may cause the rod to slip out of its position again causing the energy to be quickly released from the torsion spring and capable of causing injury.

In the past it has been attempted to design wrenches particularly for winding of the torsion springs of overhead doors. However, these wrenches of the prior art tend to be complicated devices which are not easily installable in position and because of their complexity are expensive to manufacture.

SUMMARY OF THE INVENTION

The torsion spring tensioning tool of the present invention utilizes a split housing which is to be separated and then installed about the winding cone of a torsion spring assembly. This housing is fixed on the winding cone by pins from the housing extending to within holes provided in the winding cone. Mounted on the housing is a sprocket and on each side of the sprocket is an annular groove. A separate ratchet tool is to be connected to each groove and actually be locked in place in conjunction with the groove so as to eliminate disengagement of the ratchet tool from the groove. Each ratchet tool comprises in essence an elongated bar. Each elongated bar is to be raised from a lower position to an upper position which will result in the housing being pivoted and the winding cone being pivoted, creating potential energy in the torsion spring. When one tool is raised its maximum amount, the second tool is then used to be raised while the first tool ratchets about the sprocket. The first tool is then ratcheted back to a lower position and then is raised again the second tool then to be ratcheted to a lower position to again be raised. When the desired potential energy has been obtained within the spring, the winding cone is then fixedly secured to a torsion shaft which extends through the torsion spring. The torsion is connected to the overhead door by a cable assembly.

The primary objective of the present invention is to construct a torsion spring tensioning tool which eliminates the possibility of the tool disengaging from the winding cone of the torsion spring thereby eliminating the possibility of any injury to the installer.

Another objective of the present invention is to construct a torsion spring tensioning tool which is non-complex in construction and which can be operated safely, even by unskilled individuals and can be manufactured at a reasonable cost.

DETAILED DESCRIPTION OF THE PREFERRED EMBODIMENT

Figure 1:
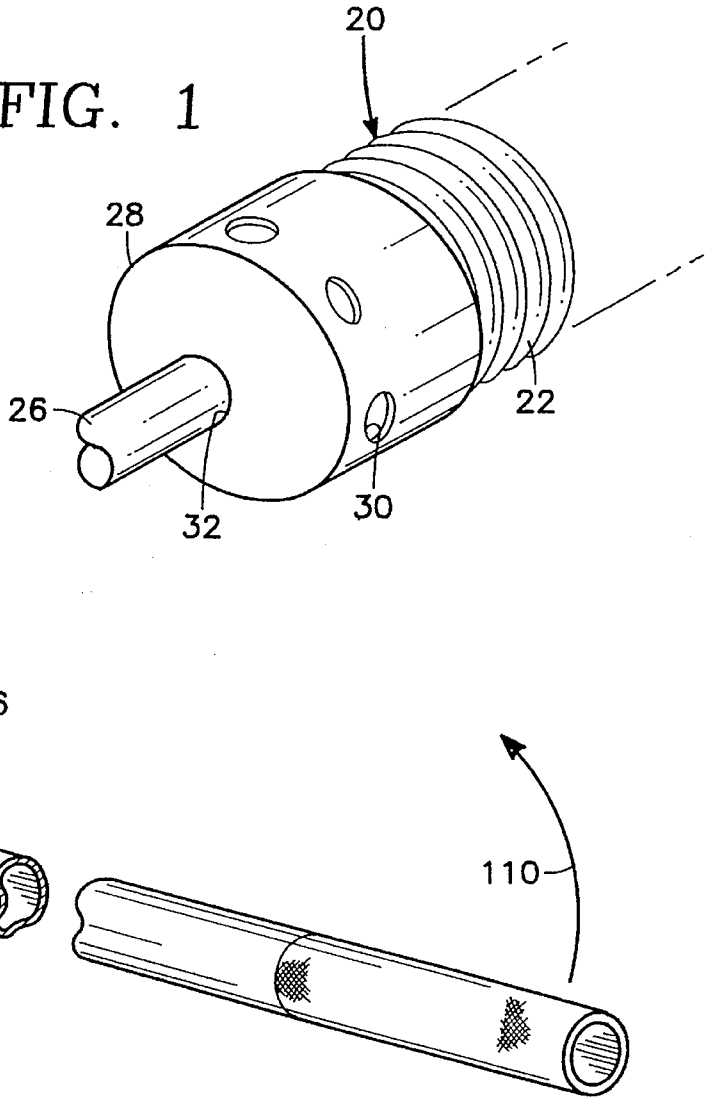
FIG. 1 is an isometric view of the winding cone portion of a torsion spring assembly that is in typical usage.

FIG. 1 depicts an end of a torsion spring 20 which is formed of a series of closely spaced coils 22. The end of the coil spring 24 is fixedly mounted on a narrowed section 24 of a winding cone 28. The torsion shaft 26 extends almost the entire length of the spring 20. The outer end of the spring 20, which is not shown, is to be secured to an appropriate fixed structure such as a wall of a building or house (not shown). The winding cone 28 is located about the shaft 26. Normally the winding cone 28 will be constructed to be solid, the outer surface of which has a plurality of spaced-apart, radially located, holes 30. The winding cone 28 includes a longitudinal center hole 32. The shaft 26 passes through the center hole 32. It is necessary that the winding cone 28 be fixedly secured to the shaft 26. In order to accomplish this, a screw threaded fastener 34 is connected between the winding cone 28 and the shaft 26. It can thus be seen that pivoting action of the winding cone 28 will result in simultaneous pivoting of the shaft 26 and twisting of the coils 22 of the coil spring 20. It is to be understood that the end of the spring 20 mounted on the narrowed section 24 will be rotated the same number of times as the winding cone 28, while the opposite end (not shown) of the coil spring 20 will not be rotated at all.

Referring in particular to FIGS. 5–8 of the drawings, there is shown a housing 36 which is formed of a right half 38 and a left half 40. The right half 38 includes a half circular recess 42 with the left half 40 including a similar half-circular recess 44. The recesses 42 and 44 connect together with the right half 38 fixed to the left half 40 by means of conventional fasteners 46 which connect with washers 48 and nuts 50. The right half 38 also includes a smaller half circular recess 52 with left half 40 also including a similar smaller half circular recess 54. These recesses 52 and 54 connect together to form a circular hole through which the torsion shaft 26 extends.

Figures 3, 4:
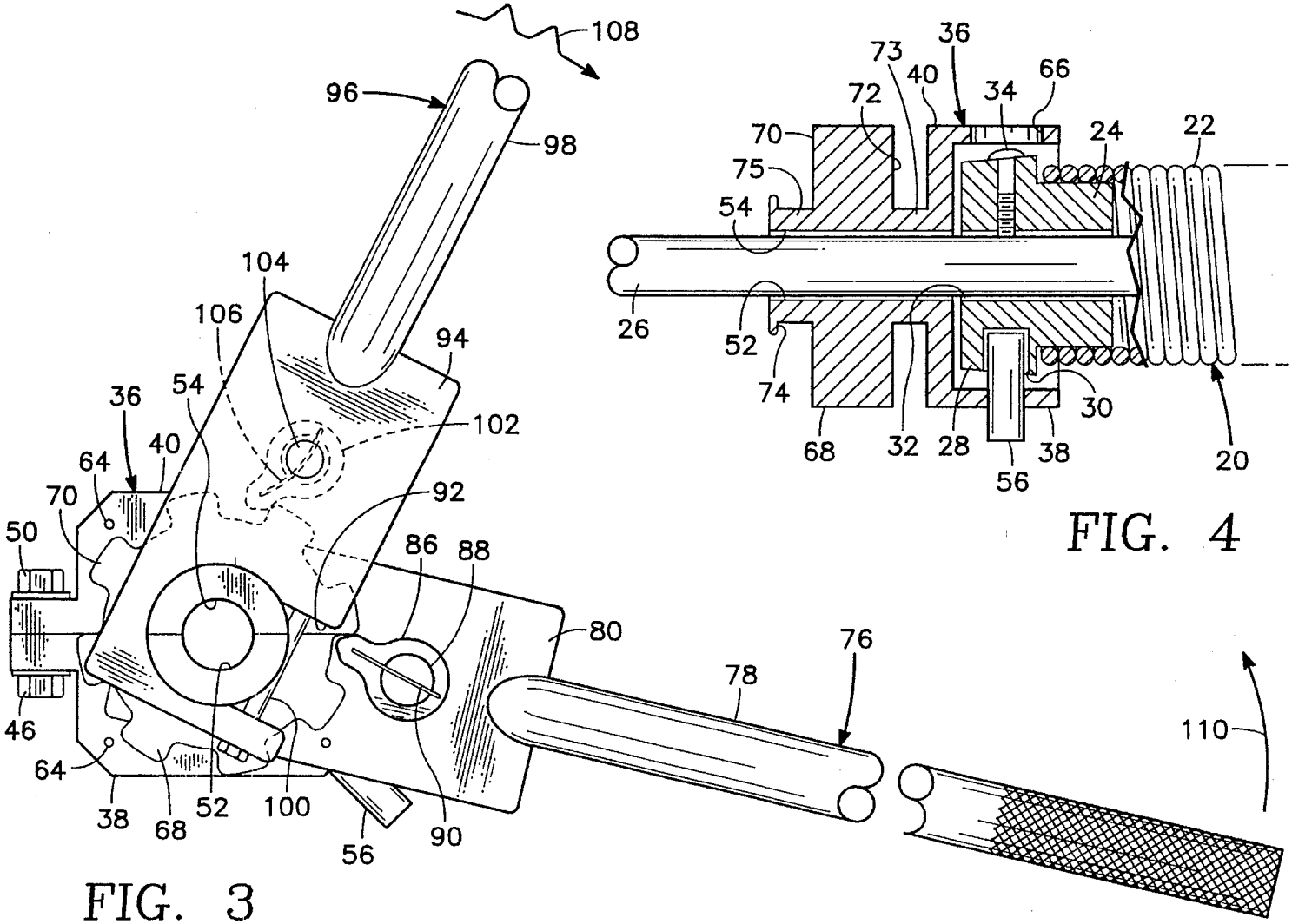
FIG. 3 is an end view of the tensioning tool of this invention depicting the usage of the separate ratchet tools in conjunction with the tensioning tool.
FIG. 4 is a cross-sectional view through the winding cone taken along line 4—4 of FIG. 2 showing the connection of the winding cone to the torsion spring.
Figure 7:
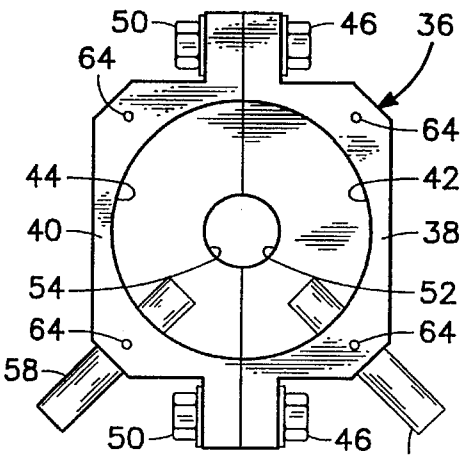
FIG. 7 is a back view of the housing of the tensioning tool taken along line 7—7 of FIG. 6.
Figure 6:
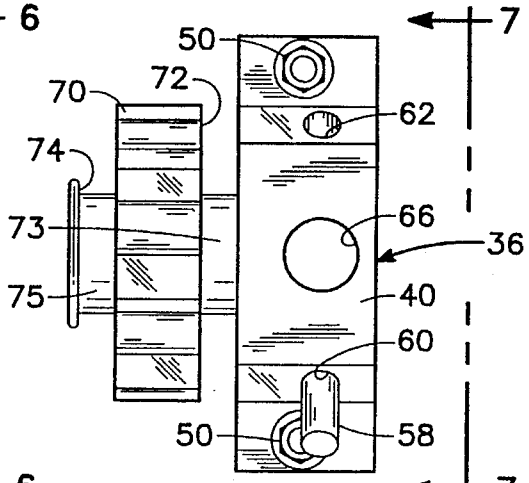
FIG. 6 is a right side view of the gear and housing taken along line 6—6 of FIG. 5.
Figure 5:
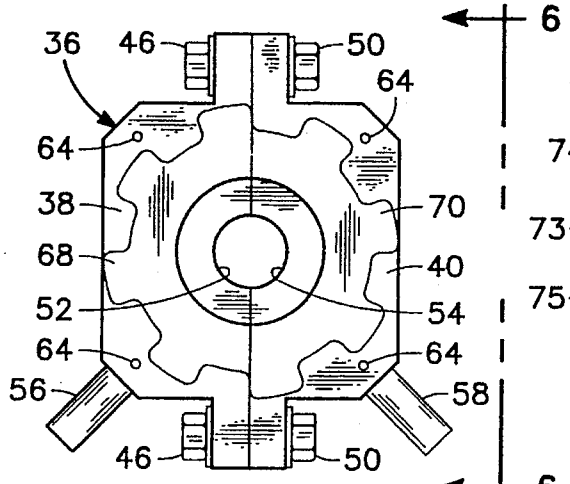
FIG. 5 is an end view of the gear and the housing of the tensioning tool of the present invention showing the housing in the assembled stated.
Figure 8:
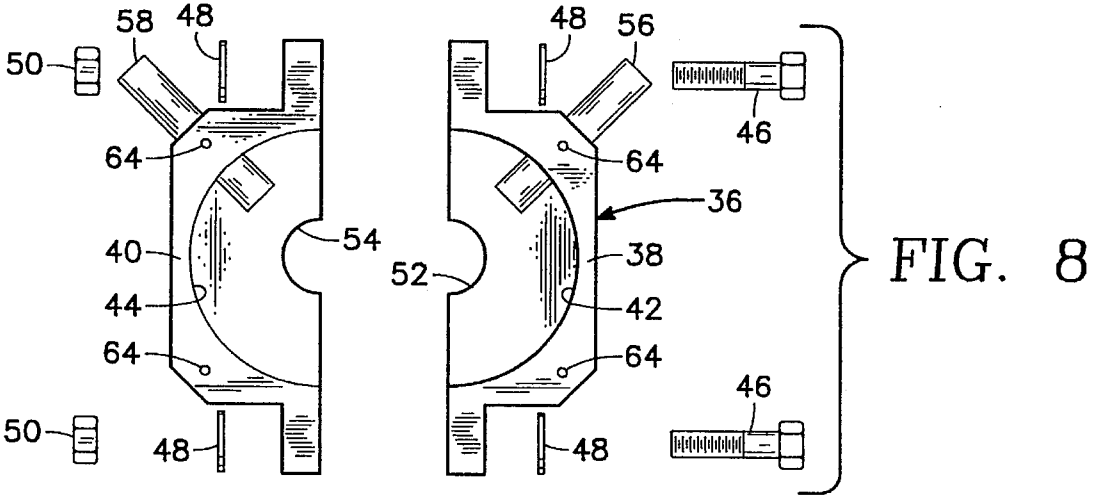
FIG. 8 is a view similar to FIG. 7 but with the housing in an exploded configuration showing the housing in a disassembled configuration.

The winding cone 28 is to be locatable within the internal chamber formed by half circular recesses 42 and 44 as is clearly shown in FIG. 4 of the drawings. It is necessary to fixedly secure the housing 36 to the winding cone 28. This is accomplished by means a pair of drive pins 56 and 58. The drive pin 56 extends through a hole formed within the right half 38 with the drive pin 58 extending through a hole formed within the left half 40. Each of the drive pins 56 and 58 extend within a separate hole 30 formed within the winding cone 28. The user has the option of placing the pin 58 within either hole 60 or hole 62 formed within the left half 40. In a similar manner there are a pair of holes formed within the right half 38 which the pin 56 is to be connectable therewith. It is to be noted that the pins 56 and 58 are shown in different holes in FIG. 8 compared to FIG. 7.

The pins 56 and 58 are extended sufficiently so as to extend within the holes 30. Once in this established position the pins 56 are then fixed in position by some conventional fastening means such as a cotter pin which is not shown and which is to be locatable within a small hole 64 for each pin 56 and 58. Formed within the left half 40 is an enlarged hole 66. The enlarged hole 66 is to be arranged to be in alignment with the bolt 34 with access to the bolt 34 being permitted by means of a conventional tool such as a screwdriver, allen wrench or square drive tool being conducted through the enlarged hole 66. There is a hole similar to enlarged hole 66 in a similar location located with the right half 38 (not shown).

Figure 2:
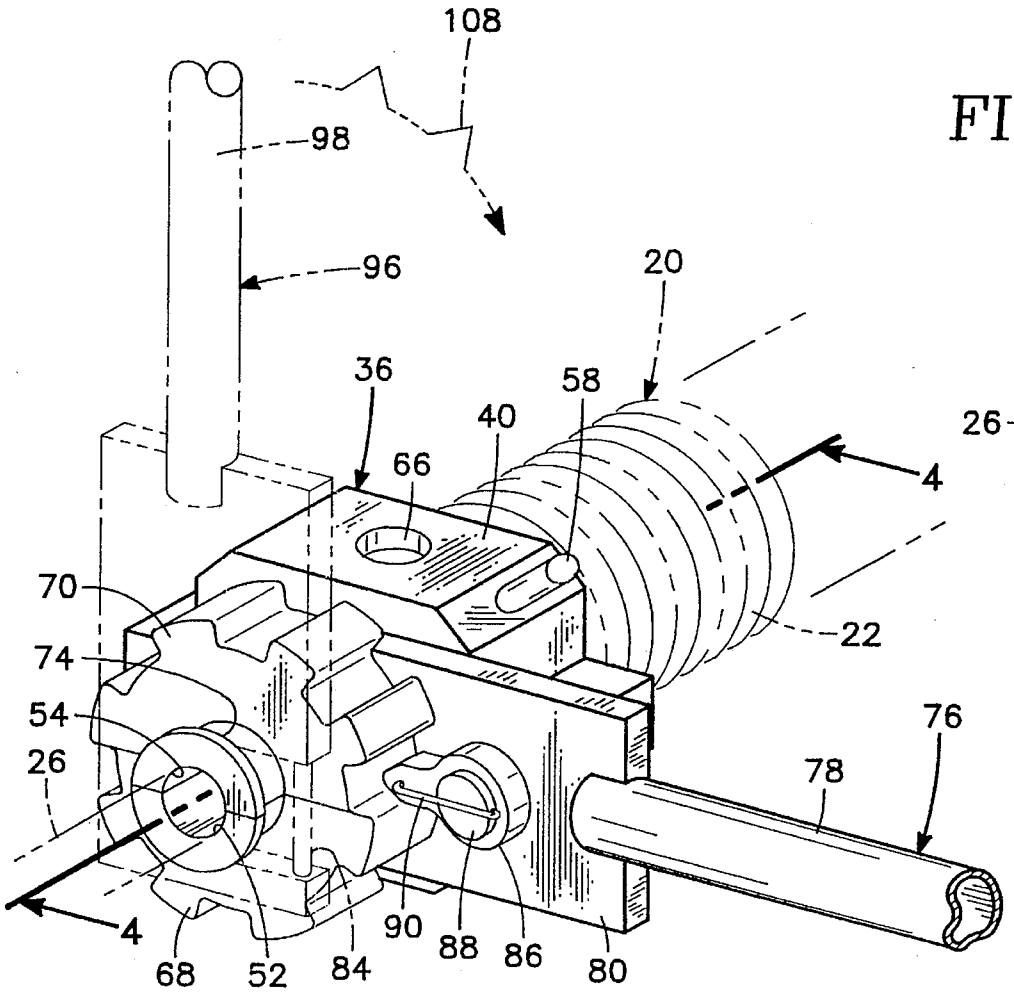
FIG. 2 is an isometric view showing the tensioning tool of the present invention being installed in place in conjunction with the winding cone.

Integrally connected to the right half 38 is one-half of a sprocket 68. Similarly, one-half of sprocket 70 is integrally secured to the left half 40. With the right half 38 being connected to the left half 40, the half sprockets 68 and 70 cooperate together to form a single continuous sprocket as is clearly shown in FIGS. 2, 3 and 5 of the drawings.

In between this single continuous sprocket and the housing 36 is located a first annular groove 72. A second annular groove 74 is located on the outer or exterior surface of the single continuous gear formed of half sprockets 68 and 70. A right hand ratchet tool 76 is used which has an elongated handle 78 connected to a flat head 80. The flat head 80 is of a width that fits within the first annular groove 72 and be capable of movement therewithin. With the flat head 80 so located, the shaft 26 and sleeve section 73 of annular groove 72 are located within U-shaped recess 82. In order to insure that the shaft 26 and sleeve section 73 will remain within the recess 82 as long as such connection is desired, there is to be utilized a locking device in the form of a bolt 84 which extends across the recess 82 with the threaded end of the bolt 84 being secured within an appropriate threaded opening (not shown) formed within the flat head 80. The head of the bolt 84 is located against the exterior top surface of the flat head 80.

Figure 9:
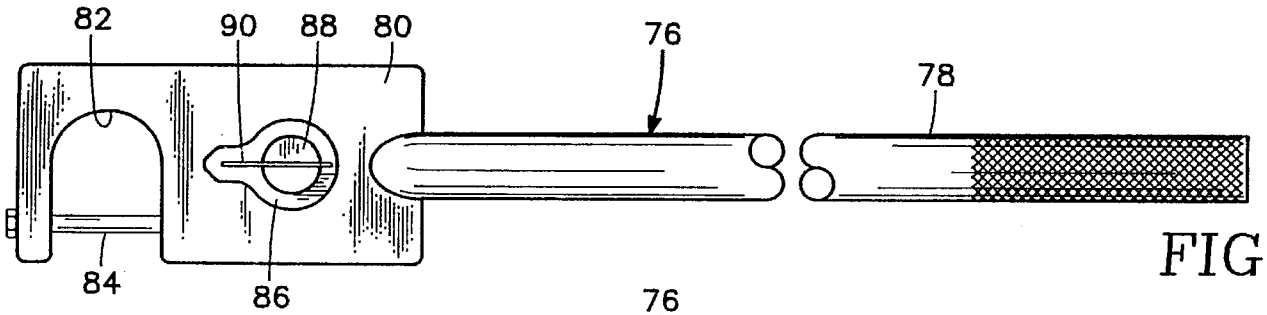
FIG. 9 is a front view of the right side ratchet tool utilized in conjunction with the tensioning tool of the present invention.
Figure 10:
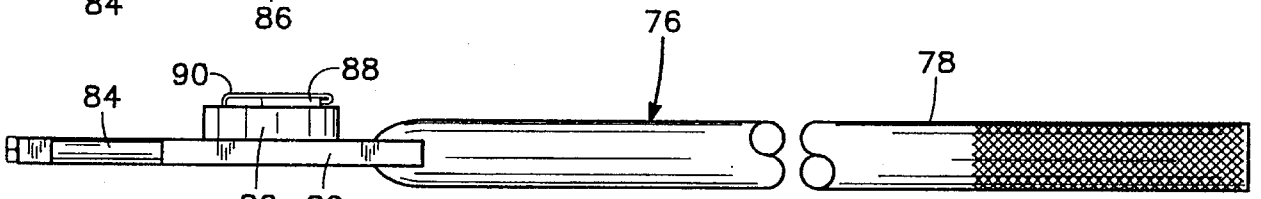
FIG. 10 is a top view of the right side ratcheting tool of FIG. 9.
Figure 11:
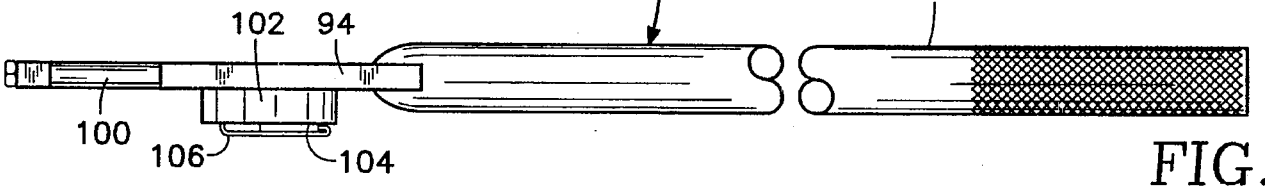
FIG. 11 is a top view similar to FIG. 10 but of the left side ratchet tool utilized in conjunction with the tensioning tool of the present invention.
Figure 12:
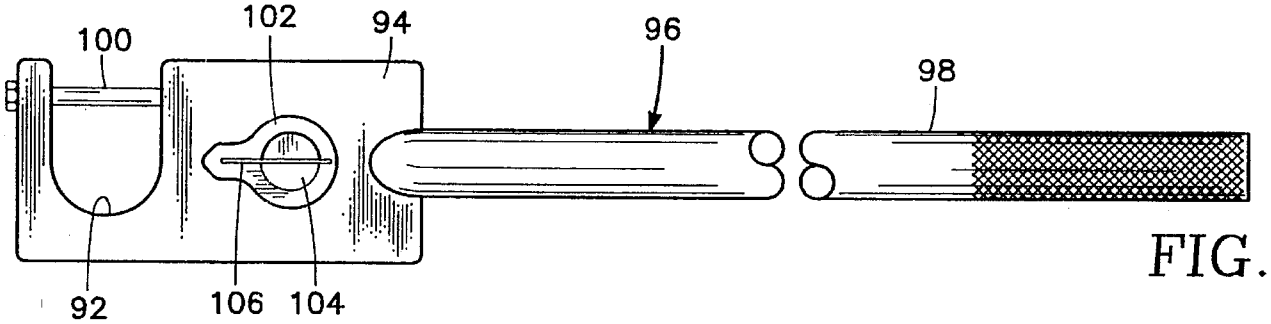
FIG. 12 is a front view of the left side ratchet tool utilized in conjunction with the tensioning tool of this invention.

Pivotally mounted on the flat head 80 is a pawl 86. The pawl 86 is pivotally mounted on a pin 88 which is integral with the flat head 80. Connected between the pin 88 and the pawl 86 is a spring 90. The function of the spring 90 is to exert a continuous bias against the pawl 86 tending to locate the pawl 86 in the position shown substantially in FIG. 9 of the drawings. Pivoting movement of the enlarged handle 78 in a clockwise direction as is shown in FIG. 3 by arrow 108 will result in the pawl 86 deflecting over the teeth of the sprocket 68, thereby achieving a ratcheting action. However, pivoting of the ratcheting tool in the opposite direction as is shown by arrow 110, which is counterclockwise, will result in the pawl 86 being pressed against one of the teeth of the half sprockets 68 and 70, thereby causing the housing 36 to pivot along with movement of the elongated handle 78.

Mounted within the second annular groove 74 is U-shaped recess 92 of a flat head 94 of a left hand ratchet tool 96. An elongated handle 98 is fixedly secured to the flat head 94. The left hand ratchet tool 96 includes a similar locking means in the form of a bolt 100 which connects across the recess 92 so as to make certain that the flat head 94 remains engaged within the annular groove 74 surrounding shaft 26 and sleeve section 75. The flat head 94 has mounted thereon a pawl 102 which is pivotally mounted on pin 104 which is integral with the flat head 94. A spring 106 connects between the pin 104 and the pawl 102. The spring 106 will permit the tool 96 to freely pivot in the direction of arrow 108. Pivoting of either ratchet tool 76 or ratchet tool 96 in the direction of arrow 110 will result in turning of the housing 36. Pivoting of ratchet tools 76 and 96 in the direction of arrow 108 will result in ratcheting which is defined as relative motion between housing 36 and tool 76 or tool 96.

The operation of the torsion spring tensioning tool of this invention is as follows. The user will separate the right half 38 from the left half 40 by disengaging of the fasteners 46. The user then mounts the right half 38 and the left half 40 together so that the pins 56 and 58 will engage within appropriate holes 30 within the winding cone 28. The user also makes sure an enlarged hole, such as enlarged hole 66, aligns with screw fastener 44. The user then tightens down fasteners 46. Normally during this installation, the pins 56 and 58 will already be in the position as shown in FIGS. 7 and 8 of the drawings. The user then takes a conventional tool and unscrews the screw threaded fastener 34 until it disengages from the shaft 26. The user then inserts the right hand ratchet tool 76 in connection with the annular groove 72 and inserts the bolt fastener 84 locking the right hand ratchet tool in position within the groove 72. In a similar manner, left hand ratchet tool 96 is mounted in conjunction with the annular groove 74 with the bolt 100 then being installed in position. The user then proceeds to move the right hand ratchet tool 76 in an upward direction as is depicted by arrow 110. This upward movement will generally be in the range of 50–80 degrees. Normally the user will complete this movement with his or her right hand. Having located the left hand ratchet tool 96 in a lower position, the user then proceeds to move the ratchet tool 96 also in an upward position 50–80 degrees, again further pivoting of the housing 36. At the same time the right hand ratchet tool 76 is permitted to ratchet to a lower position with the pawl 86 slipping over the teeth of the sprockets 68 and 70. With the left hand ratchet tool 96 in the now upward position, the right hand ratchet tool 76 is again moved from the lower position to the upward position as represented by arrow 110. This sequential pivoting arrangement between the ratcheting tools 76 and 96 is to be repeated causing the rotation of the winding cone 28 and twisting of the spring 20. Movement of tools 76 and 96 is continued until sufficient potential energy is stored within the spring 20 at which time the user is to take a conventional tool and tighten the screw threaded fastener 34 onto the shaft 26. This will prevent relative movement between the shaft 26 and the spring 20 and provide the desired amount of stored energy for the overhead door (not shown) when the overhead door is moved from a lower closed position to an upper open position. The potential energy within the spring 20 will counterbalance the bulk of the weight of the overhead door.

When the screw threaded fastener 34 is tightened onto shaft 26, the bolts 84 and 100 are disengaged from their respective flat heads 80 and 94. This will permit the tools 76 and 96 to be removed. Once removed, the fasteners 46 are also removed and the right half 38 and the left half 40 disconnected from the winding cone 28. The tensioning tool of the present invention is then capable of being used to wind another torsion spring.

What is claimed is:

1. A tensioning tool for a torsion spring assembly comprising:

a housing having an internal chamber, said housing being splittable into a first part and a second part, said first part and said second part being securable together into a single unit and adapted to be located about a portion of a torsion spring assembly;

means located within said internal chamber for fixing said housing to said torsion spring assembly;

a sprocket fixed to said housing, said sprocket located exteriorly of said housing, said sprocket having an exterior surface, said sprocket also being splittable into two parts when said housing is split;

separate ratchet tool means connectable with said sprocket, said ratchet tool means to be manually operated to cause pivoting of said portion of said torsion spring assembly to thereby induce stored energy therein; and a first annular groove formed between said sprocket and said housing, said separate ratchet tool means comprising a right hand ratchet tool and a left hand ratchet tool, said right hand ratchet tool to be connectable with said first annular groove, a second annular groove abutting said exterior surface of said sprocket, said left hand ratchet tool to be connectable with said second annular groove, whereby said right hand ratchet tool and said left hand ratchet tool to be sequentially manually used in unison to induce said stored energy within said torsion spring assembly.

2. The tensioning tool as defined in claim 2 wherein:

said right hand ratchet tool including first locking means for locking said right hand ratchet tool within said first annular groove, said left hand ratchet tool including secured locking means for locking said left hand ratchet tool within said second annular groove, both said first and second locking means being disengageable for the purpose of separating said first and said second ratchet tools from their respective said annular grooves.

* * * * *